US008292030B2

(12) United States Patent
Ballantyne

(10) Patent No.: US 8,292,030 B2
(45) Date of Patent: Oct. 23, 2012

(54) MOBILE EAVE HOOK SYSTEM AND METHOD

(76) Inventor: Flent Ballantyne, Plano, TX (US)

( * ) Notice: Subject to any disclaimer, the term of this patent is extended or adjusted under 35 U.S.C. 154(b) by 221 days.

(21) Appl. No.: 12/609,171

(22) Filed: Oct. 30, 2009

(65) Prior Publication Data

US 2010/0108442 A1 May 6, 2010

Related U.S. Application Data

(60) Provisional application No. 61/193,148, filed on Oct. 31, 2008.

(51) Int. Cl.
*A62B 35/00* (2006.01)

(52) U.S. Cl. ..... 182/45

(58) Field of Classification Search ..... 280/32.5, 280/32.6, 29, 87.1, 47.34, 79.11, 79.3; 182/45
See application file for complete search history.

(56) References Cited

U.S. PATENT DOCUMENTS

| | | | | |
|---|---|---|---|---|
| 4,398,620 | A * | 8/1983 | Townsend | 182/45 |
| 5,036,949 | A | 8/1991 | Crocker et al. | |
| D321,796 | S * | 11/1991 | Forrand | D6/330 |
| 5,137,112 | A | 8/1992 | Nichols | |
| 5,607,029 | A | 3/1997 | Beckham | |
| 5,730,246 | A | 3/1998 | Beard | |
| 6,112,853 | A | 9/2000 | Beard | |
| 6,681,893 | B1 * | 1/2004 | Coulson | 182/107 |
| 6,817,066 | B1 * | 11/2004 | Williams et al. | 16/435 |
| 7,686,566 | B1 * | 3/2010 | Murphy | 414/800 |
| 2006/0054399 | A1 | 3/2006 | Dudschus | |
| 2006/0156645 | A1 | 7/2006 | Munday | |
| 2007/0272485 | A1 * | 11/2007 | Baake | 182/45 |

FOREIGN PATENT DOCUMENTS

| | | | |
|---|---|---|---|
| DE | 3445682 | A1 * | 6/1986 |
| DE | 3719953 | A1 * | 12/1988 |
| GB | 2113285 | A * | 8/1983 |
| JP | 10-146397 | | 6/1998 |
| JP | 2006-102219 | | 4/2006 |
| WO | 9949154 | | 9/1999 |

OTHER PUBLICATIONS

International Search Report dated May 19, 2010 to corresponding international patent application No. PCT/US2009/062695, 3 pages.

* cited by examiner

*Primary Examiner* — Alvin Chin Shue

(57) ABSTRACT

An anchoring device, system and method. The anchoring device, system and method can include one or more rolling hook devices designed to couple or be secured to a projection such as those associated with rooftops. The rolling hook devices can include an arched member and any number of wheels to facilitate positioning. The rolling hook device may further be coupled to one or more tethers that allow it to serve as an anchor or work in conjunction with any number of other devices that function together as an anchoring system.

8 Claims, 3 Drawing Sheets

MOBILE EAVE HOOK SYSTEM AND METHOD

RELATED APPLICATION

This application claims benefit under 35 U.S.C. §119(e) to U.S. provisional patent application No. 61/193,148, filed on Oct. 31, 2008, the contents of the disclosure of which are incorporated by reference herein in its entirety.

BACKGROUND

Different types and configurations of anchored restraint devices and systems are well known, especially in the construction and repair industry. Many of these are rooftop safety systems configured to restrain a climber from accidentally sliding down a roof slope and tumbling to the earth or sidewalk.

The U.S. Pat. No. 6,112,853 granted to BEARD (Beard '853) shows a fall restraint system which protects a climber while inspecting and/or repairing a roof of a building. The restraint system includes a ladder positioned against a building. Beard's fall restraint device is removably connected to the ladder and contacts the roof. A cable support structure is connected to the fall restraint device, and a safety cable is attached thereto. The safety cable extends from the cable support structure toward a roof peak, and from the peak toward the ground. The safety cable is adapted to be connected to a harness worn by the climber. The worker then uses the cable as a safety line while inspecting or repairing the roof.

The NICHOLS U.S. Pat. No. 5,137,112 shows an anchor in the form of a staple cut from a steel sheet. The staple would have two parallel legs of rectangular cross section joined at one end by a broader web portion. The staple is driven partway into a roof understructure, leaving the web spaced therefrom to define an aperture for connection of a fall restraint lifeline to the staple which acts as an anchor for the lifeline.

U.S. Pat. No. 5,730,246 issued to BEARD ('246) shows another fall protection system provided for protection of a worker on a building roof. The Beard ('246) system includes a mast assembly resting on the ground and contacting a roof soffit. A cable support structure is secured to the mast assembly and a cable is connected at a first end to said cable support structure. This cable includes a first portion extending upwardly from the cable support structure toward a peak of the roof and a second portion extending downwardly from the peak toward the ground and terminating at a second end. The second portion is adapted to connect to a harness secured to the worker. A weight hangs from the second end of the cable to hold the cable taut.

The U.S. Pat. No. 5,036,949 granted to CROCKER et al. ('949) features a motion-stopping safety system for persons, workers and, in one embodiment, roof workers. Crocker teaches an anchor for gripping a structural member useful in such systems. In one embodiment such a gripping anchor has a C-shaped body member with facing members secured thereto and a line connection device, e.g. an opening or a clevis, shackle, or metal loop, connected to the body member. In one embodiment a motion-stopping safety system uses two or more such anchors between which extend a rope, line, cable, etc., and to which a person's safety tether is movably or immovably attached.

A World Intellectual Property Organization (WIPO) published application WO9949154 filed by BALLANTYNE ('154) illustrates a safety system for roof workers comprising roof fixing means adapted to be connected to one edge of a roof along with a harness worn by a roof worker on the opposite side of the roof. A safety rope connects the harness to the roof fixing means. The roof fixing means may be a roof anchor having a hook which hooks to the lower edge of roof cladding (such as metal sheet) or roofing tile. A clamping bolt fixes the roof anchor to the cladding.

BALLANTYNE ('154) further teaches an alternative system wherein the roof fixing means may be a clamp adapted to be mounted to a rafter or similar roof frame member. The clamp has a toothed pawl which resists movement of the clamp along the rafter. A clamping bolt (38) can also be provided to fix the clamp relative to the rafter.

The Published US Patent Application No. 2006/156645 by MUNDAY ('645) describes a portable anchor for use on a roof, wherein the anchor comprises a force distribution member and connection means for receiving a load support line. The Munday connection means is positioned around the junction between an attachment member and a force distribution member. The attachment member is preferably an elongate arrangement with a gap between a first side structure and a second side structure in the form of a clamping arrangement. The gap is dimensioned to receive an edge of the roof and preferably has a stop member which can be positioned against an edge of the roof cladding.

MUNDAY ('645) further explains that the force distribution member is preferably dimensioned and configured to mate with corrugations or other indentations in the roof to resist lateral displacement. The connection means is positioned towards the junction of the arm and an elongate member to resist the tendency for lateral rotation and displacement of the roof anchor as a harnessed climber/worker moves laterally on the roof. The clamping means is preferably formed from two clamping arrangements such as cammed catches or threaded bolts.

While the published patent documents mentioned above partially address the need for safety systems for anchoring rooftop climbers, they unfortunately introduce other hazards. For example, where hooks or other anchor attachments are suggested to be secured at a roof edge, the climber is placed in a precarious position while engaging or placing the anchor.

Moreover, known prior art systems and mechanisms are viewed as either too complex, time consuming, difficult to apply or causing permanent damage or unattractive modification to at least a portion of the rooftop. Furthermore, known devices and systems for such applications are ineffective, inefficient and generally dangerous when used.

SUMMARY

Methods, systems and apparatuses for using anchoring devices may be described herein. An exemplary method includes coupling a tether to a trailing side of a rolling hook device; positioning the rolling hook device on a projection; pulling the tether to secure the rolling hook device to the projection; and coupling a weight to an end of the tether opposite the rolling hook device.

One exemplary system for anchoring a device to a rooftop includes a first tether coupled at a first end to a first anchoring device that is rolled down a rooftop and secured to an eave and a weight coupled to a second end of the first tether; a second tether coupled at a first end to a second anchoring device that is rolled down the rooftop and secured to an eave and a weight coupled to a second end of the second tether; and a coupling of the first tether and the second tether to a third tether such that the third tether can support a predetermined amount of weight.

Additionally, an exemplary anchoring device may be described. The anchoring device can include a first axle coupled to a first wheel and second wheel; a second axle coupled to a third wheel and fourth wheel; and an arched member, the arched member coupled to the first axle and the second axle, the arched member further contoured to fit around an abutment.

BRIEF DESCRIPTION OF THE FIGURES

Advantages of embodiments of the present invention will be apparent from the following detailed description of the exemplary embodiments thereof, which description should be considered in conjunction with the accompanying drawings in which.

DETAILED DESCRIPTION OF THE INVENTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description, discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the terms "embodiments of the invention," "embodiments" or "invention" do not require that all embodiments of the method, system or apparatus include the discussed feature, advantage or mode of operation.

Figure 1:
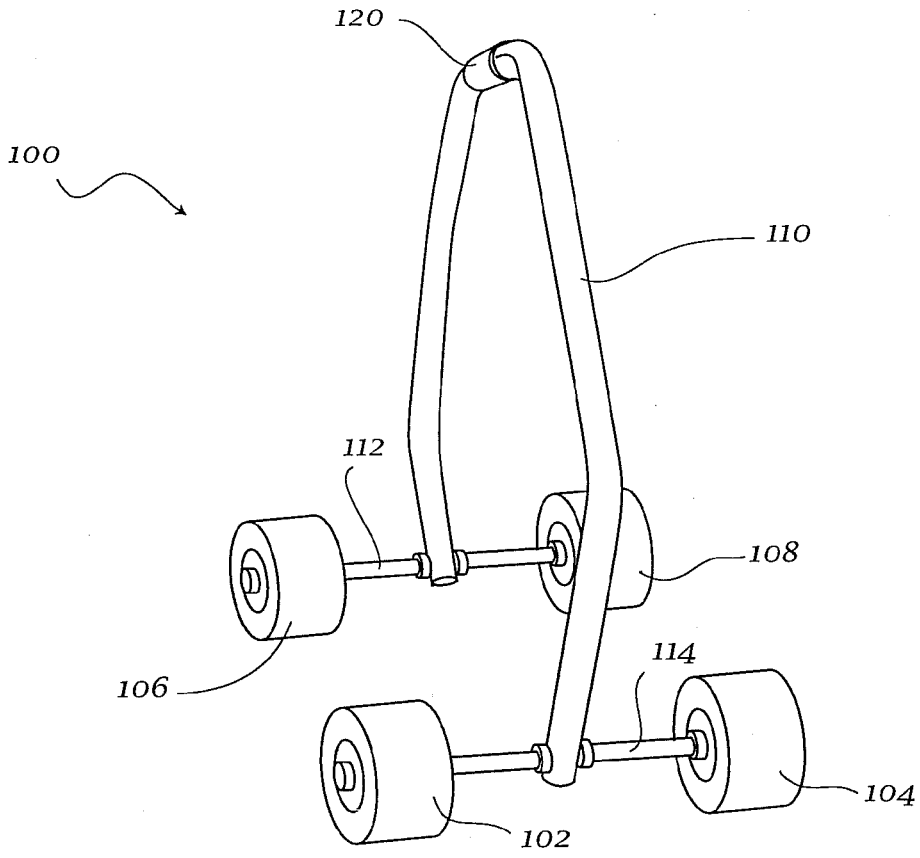
FIG. 1 is an exemplary perspective view of a mobile eave hook device.
Figure 2:
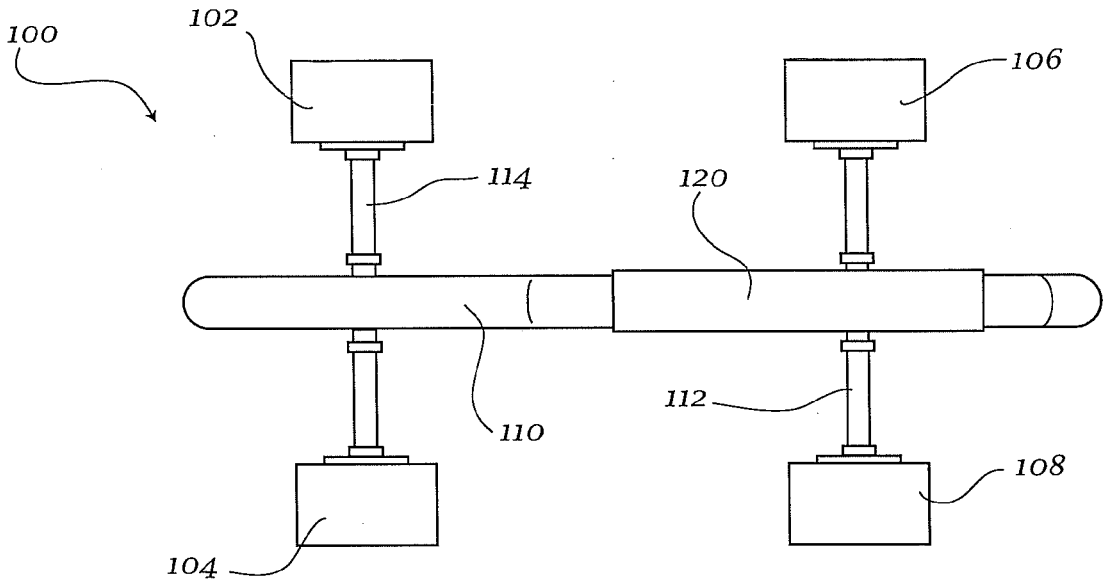
FIG. 2 is an exemplary top-down view of a mobile eave hook device.

With general reference to exemplary FIGS. 1-2, a traveling or mobile eave hook device 100 or anchor may be shown as having four wheels 102, 104, 106 and 108. In fact, more or fewer wheels could be used with equivalent effect. The wheels can be made of any desired materials such as rubber or plastic, and may also have a slide-resistant surface for reasons to be described below. Wheel axles can be interconnected through an arched member or bow 110 that extends continuously from axle 112 to axle 114 forming an open hook along the arched member 110. The arched member 110 may be constructed of any relatively strong material such as tubular steel or the like. Arched member 110 may be configured so as to be more open or spread apart adjacent the wheel axles 112 and 114 than at either the axle connection or any other portion of the arched member 110 so as to define a widely open area for easily enveloping a projection, such as a roof eave, over which the eave hook 100 can be engaged.

Figure 3:
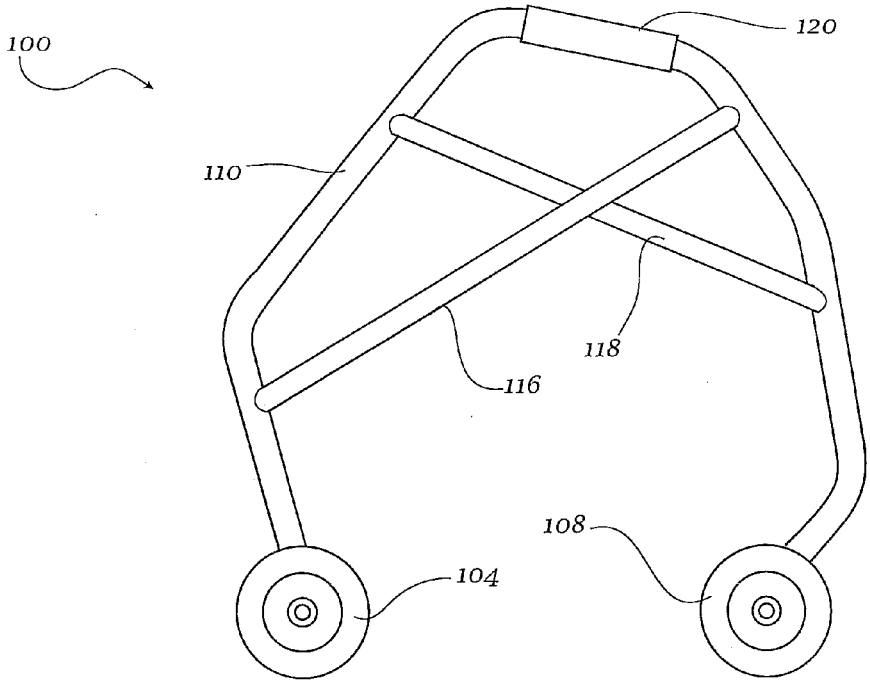
FIG. 3 is an exemplary view of a mobile eave hook device used in an exemplary embodiment.

To reinforce or strengthen the eave hook 100 configuration, and now referring to exemplary FIG. 3, reinforcement members 116 and 118 (which may be in the form of rods, bars, strips and the like) may be attached to bridge opposing portions of the widely open area, defined by the eave hook 100 arched member 110. The embodiment shown in FIG. 3 is only exemplary, however, and any desired orientation of reinforcement members may be utilized as desired.

Referring back to FIGS. 1-2, a taped or wrapped portion 120 may be included on the arched member 110 or otherwise on an upper segment of the eave hook device 100. The wrap 120 may be a rubber or rubberized material that may enhance or ensure a secure grip by a user when carrying or placing the eave hook device 100. The wrapped grip 120, since it may comprise a high friction surface, can have a further advantage when placed on a rooftop or other elevated area where it may be deployed. For example, when eave hook device 100 is placed on its side, the wrap 120 on device 100 can frictionally engage a surface, such as a rooftop surface, to help prevent the eave hook 100 from inadvertently sliding off the surface.

The side profile shape of the open arched hook member 110 may be formed in any of a variety of shapes, for example it may be formed to have certain bends or angular relationships that facilitate its movement into place about a projection, roof eave and soffit engagement and the like. It will be apparent that other, similar equivalent profile shapes may be appropriate and workable and the profile shown herein is merely an example.

Additionally, the eave hook device 100 may be formed in any size. For example different sizes of eave hook device 100 may be desirable when using the device 100 with projections or eaves of different size. Further, as member 110 may be used as a carrying assist, for example by positioning member 110 of device 100 on the shoulder of a user, different sizes or shapes of eave hook device 100 may be utilized to further increase the comfort or security of a user of the device 100 as well as to increase the security of the device 100 with respect to an eave. In some further exemplary embodiments, eave hook device 100 may be transported or moved in any of a variety of manners, for example by the connection of a rope to eave hook device 100 to enable hoisting of the device 100 to a working location.

Figure 4:
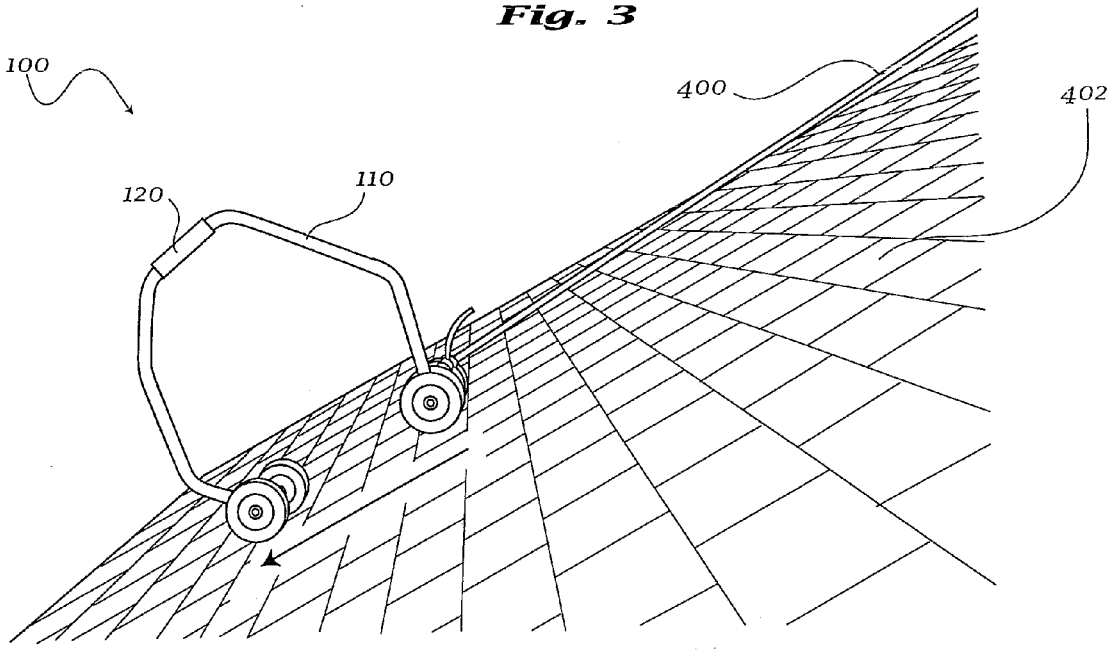
FIG. 4 is another exemplary view of a mobile eave hook device used in an exemplary embodiment.

In a further exemplary embodiment, and as shown in FIG. 4, a rope or the like may be coupled with eave hook device 100. In this example, tether line 400 may be coupled to arched member 110 at any desired location, for example a trailing end of eave hook device 100. Thus, if a user is lowering eave hook device 100 down a sloped surface, such as a roof, it may be desirable to couple rope 400 to arched member 110 at a position proximate the near or far end of arched member 110. Similarly, tether line 400 may be coupled to both arched member 110 and either of axles 112 and 114. Additionally, in some further exemplary embodiments, eave hook device 100 may have a slot or other defined rope attachment segment defined in arched member 110, axle 112 or axle 114. In still further exemplary embodiments, device 100 may have one or more tabs which can act to receive an anchoring device, such as a carabiner, which may facilitate the attachment of a tether line or similar to device 100.

Still referring to exemplary FIG. 4, after a user (not pictured) ensures that the eave hook device 100 tether line 400 is securely attached in place at the hook device trailing end, the user may proceed to lower eave hook device 100 down a roof slope 402 or similar from a roof ridge or peak (not pictured). The traveling eave hook device 100 may further be configured to maintain its upright balance and to navigate about or over rooftop obstructions such as those which may be typically found in such an environment.

Figure 5:
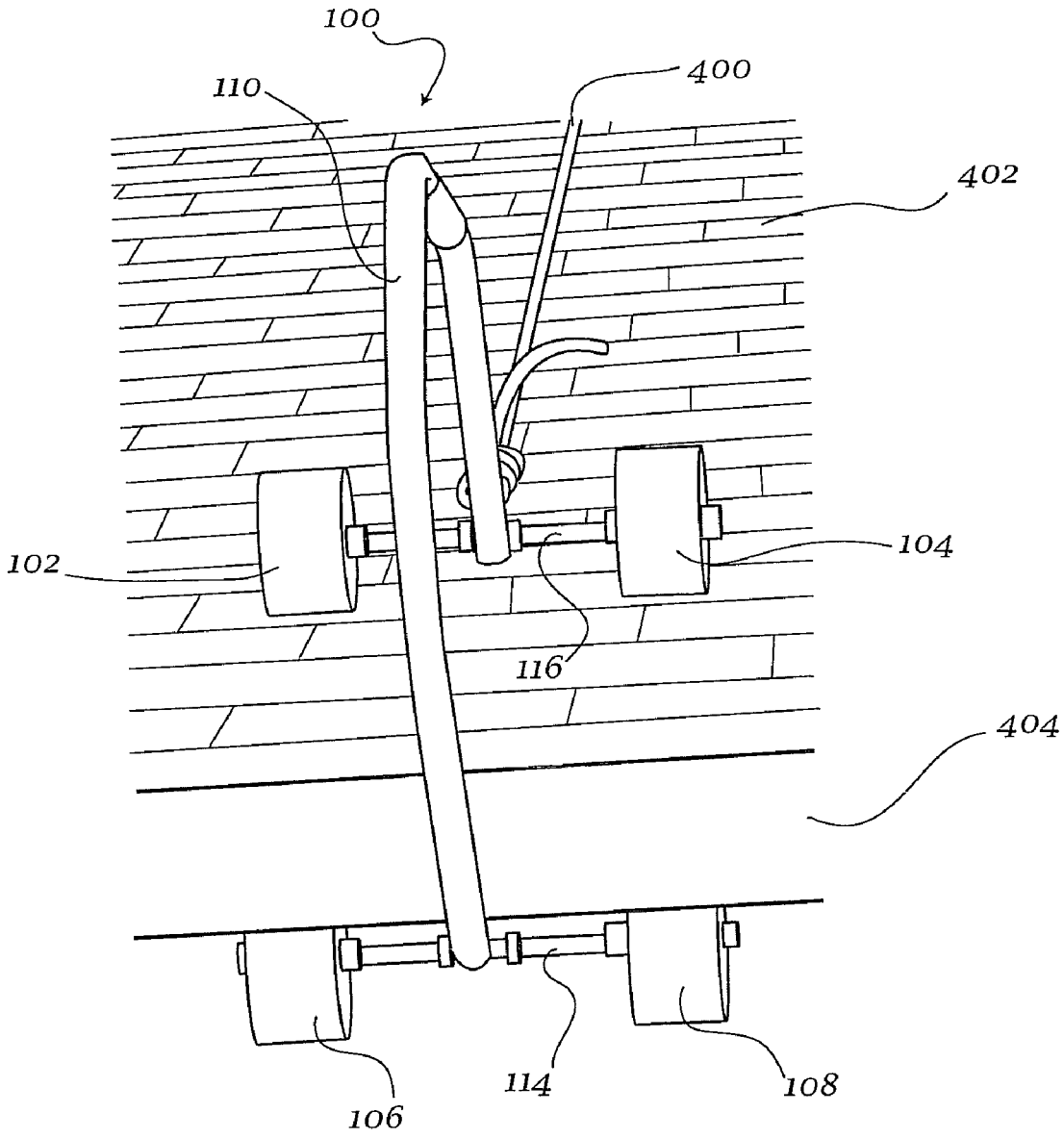
FIG. 5 is another exemplary view of a mobile eave hook device used in an exemplary embodiment.

As further shown in exemplary FIG. 5, as the traveling eave hook device 100 reaches the roof edge 404, the leading wheels 106 and 108 of the device 100 may drop below the roof edge 404. The eave hook device 100 may then swing inwardly below the roof edge 404 to engage a soffit or under-roof surface (not pictured). Then the eave hook device 100 may be tensioned or pulled by the tether line 400 so as to draw it tightly into place, while the trailing wheels 102 and 104 (at the device 100 tethered end) remain on the roof surface 402 above the lower wheels 106 and 108. The arched member 110 of the eave hook device 100 along with its overall length and wheel size can permit this hooking motion as the eave hook device 100 engulfs or surrounds and encloses the roof edge 404. The eave hook device 100 can further traverses gutters and fascia panels with ease, as well as any other obstacles or impediments that may be associated with a projection or rooftop. For some exemplary applications to rooftops, the eave hook devices 100 may be utilized with residential roofs with strong or structurally sound eaves. Further, the eave hook device 100 may be used on any type of roof, for example roofs on homes which are sloped and having peaks extending higher than the eave hooks, when attached to the eaves.

After engaging the eave hook device 100 on the roof or projection, a weight (e.g., a backpack with about 10 pounds of ballast) may be secured to the eave hook device tether 400, at the opposite end of the tether 400 from the device 100, and placed on the rooftop 402 on the opposite side of the house from the mobile eve hook device 100 with the tether 400 taught between the weight and the eve hook device 100, where there is also a peak on the roof 402 between the device 100 and the weight. Alternatively, a weight could be lowered from a roof 402 edge opposite to the hooked or anchored edge. A rubber or other high friction pad may be desired to be placed between tether lines 400 and roof 402 ridges so as to protect the rooftop from damage from the rope, to protect the rope and/or to enhance the load capacity of the anchoring system. Optionally, the friction padding may be accomplished by appropriately wrapping the tether lines 400 at their roof 402 ridge junctions.

After eave hook device 100 is secured to roof edge 404, tether line 400 may be attached to any other devices or components, for example other tether lines attached to other eave hook devices or other ballasts. Such attachments or couplings may allow for any number of users to further couple themselves to one or more tether lines which may then serve as an anchor or otherwise allow them to work safely or without the threat of falling off of a rooftop or similar structure.

As discussed above, additional eave hook anchoring devices may be lowered into place along any other roof edges, or hand positioned at roof edges adjacent to roof peaks. Further, any devices may be secured and oppositely anchored through use of knotted tension lines or any other desired manner, for example through the use of connecting devices, other than knots, such as anchorage connectors, carabiners and the like. This coupling of eave hook devices 100 can allow for at least one working baseline from which the rooftop climbers may be tethered for safety and can support any desired amount of weight. For example, different numbers of eave hook devices 100 may be coupled with different types of tethers or ropes to support a desired or predetermined amount of weight, for example the weight of one or more users of an anchoring system. Users of the eave hook device 100, such as rooftop climbers, can deploy retractable tension lines as are known in the art so as to tether themselves to the securely anchored baselines. Firmly engaged around roof and soffit edges, the eave hook devices 100 can then safely hold the climbers as they go about their rooftop tasks such as making repairs, construction, adding decorations or signage without fear of falling.

In other exemplary embodiments, some elevated projects may actually demand a climber's rappelling activities, such as careful movement down particularly steep roof slopes or even along a vertical building or house surface. The securely anchored baselines afforded by the eave hook devices 100 described herein make a sound and reliable connection for rappelling lines used by skilled climbers. Standard rappelling gear, such as rappelling belts or harnesses, belay devices and fast straps, as well as safety helmets, may further be utilized for such activities.

In yet another exemplary embodiment, it may be desired, if the highest roof peak between a supporting eave hook device 100 engaged under a roof edge 404 and a user has enough friction, to make the tether line 400 grab the rooftop 402. An example would be the level of friction between the tether line 400 and a typical, good condition asphalt shingle roof; or the friction between the tether line 400, a rubber mat and a steel roof. In some examples, placement of a high friction mat or pad is may be desired on the highest peak between opposing mobile eave hooks 100. This can provide a stronger support as well as protection for both the rope and roof from abrasion. In some exemplary situations, deployment of four eave hook devices 100 on four sides of an average house can provide support that can be used to help protect a climber on most parts of the roof. If work is only being done on one side of a house or two opposing sides, it may be desirable to use only two mobile eave hook devices 100. Since there are many different rooftop designs as well as other environments where device 100 may be utilized, placement of eave hook devices 100 will vary, depending on the roof design and the size and orientation of any eave hook devices 100 is such that any roof design may be accommodated.

In further exemplary embodiments, one or more eave hook devices 100 can be used in any of a variety of situations. For example, the device 100 could be rolled up a wall and then hooked to the top. The device 100 could also be lowered from a higher elevation (top of a house, barn, building, helicopter etc.) to a smooth surface such as a cellar door (may be on a slant), a dock, etc. and then manipulated to travel across the surface to an edge, bar, etc. where the device 100 could be used as an anchor or to move an object (pull open a cellar door, slide over a dock, etc.). The eave hook device 100 could further be moved by outside forces such as gravity, being pulled by a rope, pushed with a pole, etc. or it could operate on its own power with a motor, engine or other source of power.

It should be evident that the device 100, system and any components disclosed herein may be fabricated or formed in a variety of ways and from a variety of materials. The various parts may be machined, molded or otherwise fabricated from high strength materials such as steel, reinforced aluminum, tubular alloy, high-strength plastics or wood, or be manufactured from a combination of any suitable materials and processes. The choice of materials and construction are clearly within the scope of the appended claims.

Upon carefully reviewing the foregoing specification along with the accompanying drawings it will be evident that this invention is susceptible of modifications, combinations, and alterations in a number of ways which may differ from those set forth.

The foregoing description and accompanying drawings illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

The invention claimed is:

1. An anchoring device, comprising:

a first axle coupled to a first wheel and second wheel;

a second axle coupled to a third wheel and fourth wheel; and an asymmetric arched member, the arched member coupled to the first axle and the second axle, the arch member further sized and shaped to fit around and securely anchor about a roof eave, wherein the arched member includes a first portion extending away from the first axle at a first angle, and a second portion extending away from the second axle at a second angle such that a distance between the first portion and the second portion is greater than the distance between the first axle and the second axle.

2. The anchoring device of claim 1, further comprising a wrap disposed on the arched member.

3. The anchoring device of claim 2, wherein the wrap is one of rubber and a rubberized material.

4. The anchoring device of claim 1, wherein the first wheel, the second wheel, the third wheel and the fourth wheel facilitate moving the anchoring device on a surface.

5. The anchoring device of claim 1, wherein the first wheel, the second wheel, the third wheel and the fourth wheel are formed with a slide-resistant surface.

6. The anchoring device of claim 1, wherein the arched member is formed of at least one of metal, aluminum, alloy, plastic, composite or wood.

7. The anchoring device of claim 1, further comprising one or more reinforcement members coupled to the arched member.

8. The anchoring device of claim 1, further comprising a trailing edge of the arched member that facilitates coupling the arched member to a tether.

* * * * *